United States Patent [19]

Kortering et al.

[11] Patent Number: 4,660,477

[45] Date of Patent: Apr. 28, 1987

[54] SLIDABLE WORK SURFACE

[75] Inventors: Randall L. Kortering, Zeeland; Paul S. Gartland, Twin Lake, both of Mich.

[73] Assignee: Haworth, Inc., Holland, Mich.

[21] Appl. No.: 641,884

[22] Filed: Aug. 17, 1984

[51] Int. Cl.[4] ..... A47B 9/00

[52] U.S. Cl. ..... 108/108; 108/137; 108/152

[58] Field of Search ..... 108/137, 152, 143, 108, 108/102; 248/235, 243, 250, 429; 211/187, 153, 134, 90, 186

[56] References Cited

U.S. PATENT DOCUMENTS

| | | | |
|---|---|---|---|
| 3,242,885 | 3/1966 | Baker et al. | 108/137 |
| 3,574,434 | 4/1971 | Propst . | |
| 3,615,113 | 10/1971 | Visser | 292/128 |
| 4,129,198 | 12/1978 | Hunter | 108/152 X |
| 4,198,913 | 4/1980 | Haworth et al. | 108/108 |
| 4,367,971 | 1/1983 | Coren | 292/128 X |

FOREIGN PATENT DOCUMENTS

| | | | |
|---|---|---|---|
| 1312569 | 11/1961 | France | 108/152 |
| 2045061 | 10/1980 | United Kingdom | 108/137 |

*Primary Examiner*—Kenneth J. Dorner
*Assistant Examiner*—José V. Chen
*Attorney, Agent, or Firm*—Flynn, Thiel, Boutell & Tanis

[57] ABSTRACT

A work surface is mounted on a pair of brackets which are releasably mounted on and project outwardly in cantilevered relationship from a panel adjacent the opposite ends thereof. The work surface, in each end rail thereof, mounts a manually-actuated latching lever which is biased down into latching engagement with the respective bracket. The latching lever prevents the work surface from moving away from the panel and from being lifted upwardly adjacent its rear edge. The latching lever has the end thereof accessible from beneath the rear edge of the work surface so as to be manually moved upwardly to release the work surface from the bracket, whereupon the work surface can be slidably displaced outwardly away from the panel through a limited extent. When the work surface is manually slidably moved forwardly toward the panel, the latching lever automatically re-engages its respective bracket.

4 Claims, 7 Drawing Figures

SLIDABLE WORK SURFACE

FIELD OF THE INVENTION

This invention relates to a work surface assembly, such as a work surface supported on a wall or space divider panel, and in particular to an improved mounting arrangement which permits the work surface to be slidably displaced relative to its mounting to facilitate passage of power and communication cables around the front edge thereof.

BACKGROUND OF THE INVENTION

Wall structures formed from a plurality of prefabricated interconnected panels are used extensively in commercial and industrial buildings for dividing interior regions into smaller working spaces. Numerous components are provided for attachment to these wall panels to totally equip the working space for its intended utilization. These components include table or desk tops (commonly referred to as work surfaces). The work surface is typically positioned closely adjacent the panel on a pair of spaced brackets which removably attach to and project outwardly from the panel adjacent the opposite ends thereof. When so positioned, the work surface is disposed with its front edge disposed closely adjacent the outer surface of the wall panel but spaced therefrom by a small distance which permits power or communication cables to pass therebetween.

With the increased demand for various types of powered and communication equipment, and specifically the demand for mobility of such equipment, the supplying of power and communication cables to equipment mounted on the work surface has become increasingly difficult. Known structures of this type have generally required that the work surface be removed from the brackets in order to pass a plug, such as a power plug, downwardly past the front edge of the work surface due to the insufficient clearance space between the work surface and the panel. This hence requires a disassembly of the work surface from the brackets, and then a remounting of the work surface on the brackets, each time it is desired to either add or remove powered equipment.

Accordingly, it is an object of this invention to provide an improved work surface arrangement which overcomes the aforementioned disadvantages. More specifically, this invention relates to an improved mounting arrangement for a work surface which provides a clearance space between the front edge of the work surface and the surface of the panel to permit power and communication cables to pass therethrough, while at the same time maintaining this space at an absolute minimum to prevent other objects on the work surface from inadvertently falling therethrough. This improved mounting arrangement, however, can be manually released to permit the work surface to be slidably displaced relative to its supporting brackets through a small distance away from the wall panel, whereby the clearance space is sufficiently enlarged to permit larger objects such as a power cord plug to freely pass therethrough, following which the work surface can be manually slidably returned and latched into its original position. This hence facilitates the addition or removal of power equipment on the work surface without requiring that the work surface be disassembled or demounted from its supporting brackets.

In the improved work surface mounting arrangement of this invention, the work surface is mounted on a pair of spaced brackets which are releasably mounted on and project outwardly in cantilevered relationship from the panel adjacent the opposite ends thereof, this being a conventional mounting arrangement. The work surface, in each of the end rails thereof, mounts a manually-actuated latching lever which is biased down into latching engagement with the respective supporting bracket. The latching lever prevents the work surface from moving away from the panel and from being lifted upwardly adjacent its rear edge. The latching lever has the end thereof accessible from beneath the rear edge of the work surface so as to be manually moved upwardly to release the work surface from the bracket, whereupon the work surface can then be slidably displaced outwardly away from the panel through a limited extent. When the work surface is manually slidably moved forwardly back toward the panel, the latching lever automatically re-engages its respective bracket.

Other objects and purposes of the invention will be apparent to persons familiar with structures of this general type upon reading the following specification and inspecting the accompanying drawings.

Figure 7:
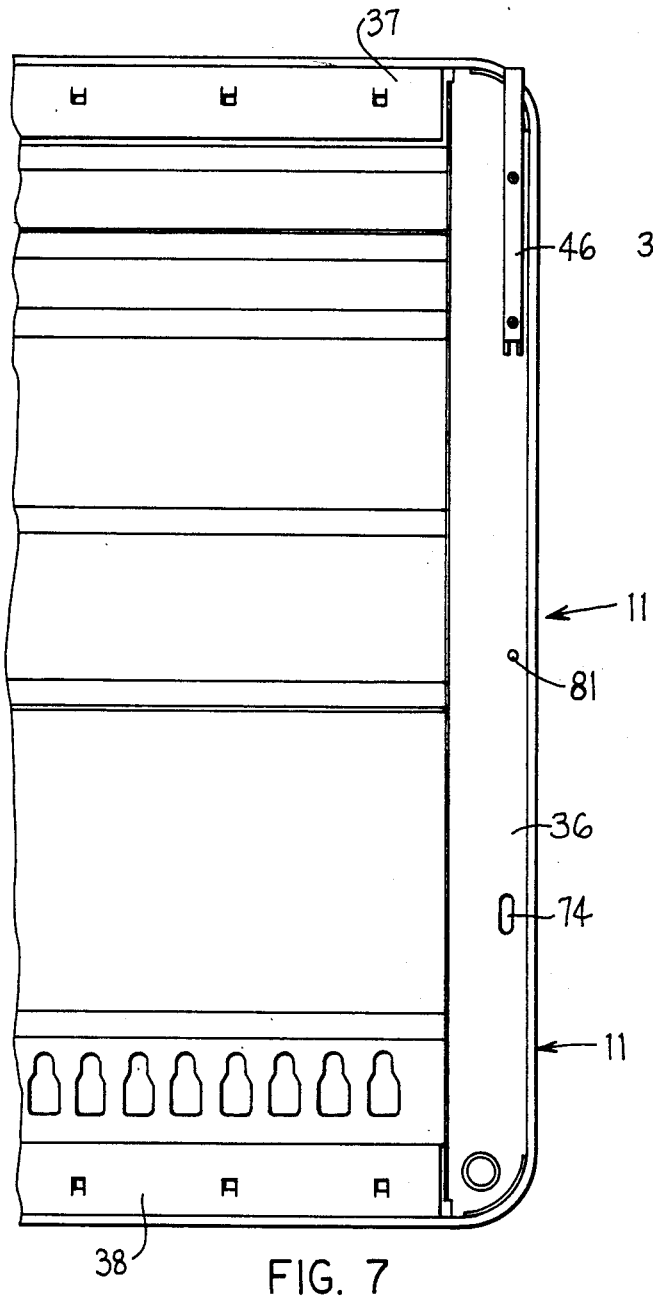
FIG. 7 is a fragmentary bottom view of the work surface as removed from its supporting brackets.

Certain terminology will be used in the following description for convenience in reference only and will not be limiting. For example, the words "upwardly", "downwardly", "rightwardly" and "leftwardly" will refer to directions in the drawings to which reference is made. The word "front" will have reference to the outer edge of the work surface member as disposed adjacent the wall panel, which edge is on the left side of FIGS. 1 and 2, and the word "rear" will refer to the opposite edge which is positioned closely adjacent a person seated adjacent the work surface, which edge is rightwardly in FIGS. 1 and 2. The words "inner" and "outer" will refer to directions toward and away from, respectively, the geometric center of the structure and designated parts thereof. Said terminology will include the words specifically mentioned, derivatives thereof, and words of similar import.

DETAILED DESCRIPTION

Figure 1:
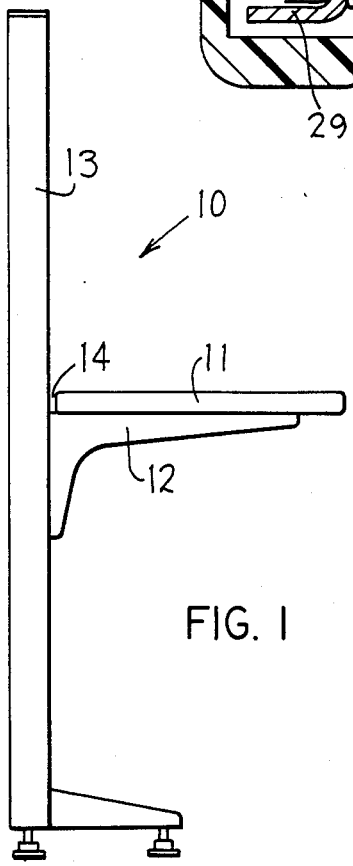
FIG. 1 is a side elevational view illustrating the attachment of a work surface member, such as a desk top, to a wall or space divider panel.

FIG. 1 illustrates a work surface assembly 10 wherein a shelflike structure (hereinafter work surface member) 11, such as a desk or table top, is positioned on a pair of spaced support structures 12, which in turn are connected to a conventional upright wall panel or partition 13 adjacent the opposite ends thereof. A small clearance space or slot 14 is normally maintained between the front edge of the member 11 and the adjacent surface of the panel 13. This basic assembly 10, as illustrated by FIG. 1, is conventional.

Figures 2, 3, 4, 5:
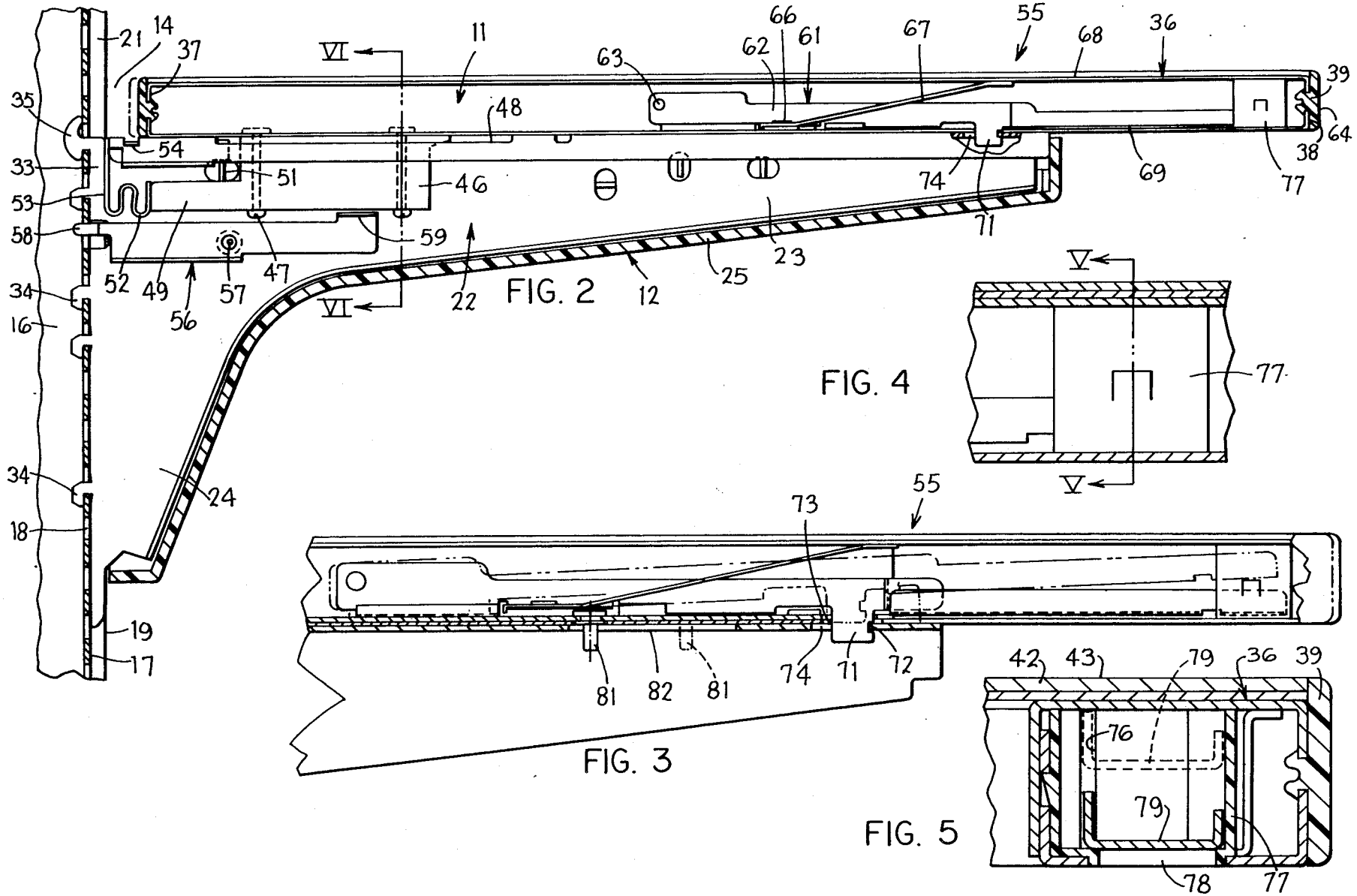
FIG. 2 is an enlarged, fragmentary elevational view taken partially in cross section and illustrating the attachment of a work surface member to a slotted upright as associated with a space divider panel.
FIGS. 3 and 4 are enlarged, fragmentary sectional views of portions of the structure shown in FIG. 2.
FIG. 5 is a fragmentary sectional view taken substantially along the line V—V in FIG. 4.

The panel 13 is normally provided with uprights or posts adjacent the opposite ends thereof, one such upright 16 being illustrated in FIG. 2. This upright 16 conventionally has a side vertical wall 17 provided with a vertically extending row of spaced slots 18 formed therein, which slots extend through the wall and are vertically elongated, the slots being generally uniformly spaced apart. The slotted wall 17 is, in the illustrated embodiment, spaced rearwardly a substantial distance from the front wall 19 of the upright, such that the upright is provided with an elongated groove or channel 21 extending vertically thereof for providing access to the slots 18.

Figure 6:
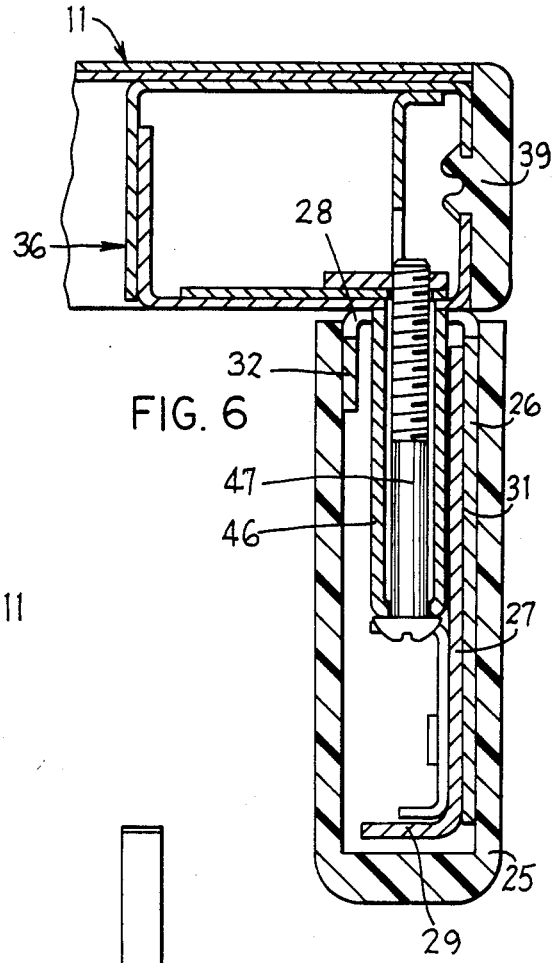
FIG. 6 is an enlarged, fragmentary sectional view taken substantially along line VI—VI in FIG. 2.

The pair of support structures 12 (only one shown in the drawings) are positioned under the opposite ends of the work surface member 11 and are identical except for being mirror images of one another so as to be attachable to the right and left ends of the wall panel 13. This support structure 12 includes a substantially L-shaped support or bracket 22 disposed within a channel-shaped cover 25, which bracket includes horizontal and vertical legs 23 and 24, respectively. The bracket 22 is formed substantially by upper and lower members 26 and 27 (FIG. 6), respectively, which are fixedly joined together and provide the bracket with a channel-shaped configuration which opens sidewardly. This structure provides the bracket with top and bottom walls 28 and 29, respectively, joined together by an outer substantially vertical sidewall 31. The top wall 28 also has a flange 32 which projects downwardly from the inner edge thereof so that the upper part of the bracket hence effectively has a downwardly opening channel-shaped configuration.

The front end of the bracket 22 has a vertical platelike part 33 (FIG. 2) which is integral with the lower member 27 and projects into the groove 21 formed in the upright 16. This platelike part 33 has a plurality of hooks 34 projecting outwardly therefrom, which hooks 34 are L-shaped and are vertically spaced apart so as to pass through the slots 18 to hence create a locking engagement with the vertical sidewall 17 in a conventional manner. A rounded T-shaped top hook 35 also projects outwardly from plate 33 and is adapted to project through one of the slots 18. The structure of the hooks 34 and 35, and their cooperation with the slots 18, is conventional and is described in greater detail in U.S. Pat. No. 4,198,913.

Considering now the general structure of the work surface member 11, same includes a pair of substantially parallel end rails 36 rigidly joined together by front and rear edge rails 37 and 38, respectively. These rails have a hollow cross section which resembles a tubular configuration, and an appropriate edge cap 39 is attached to the outer surface of each rail. A plurality of intermediate support rails 41 (FIG. 7) also extend between and are rigidly joined to the end rails 36. The rails hence form a frame structure which is used for supporting a substantially planar sheetlike top member 42 (FIG. 5), the latter having an upper surface 43 which defines a working surface.

Each of the end rails 36 mounts thereon a mounting arm 46, the latter being secured to the underside of the rail 36 by a pair of screws 47. This mounting arm 46 is of a generally channel-shaped cross section which is mounted adjacent the front end of the end rail 36 and is elongated in the lengthwise direction thereof. Mounting arm 46 is adapted to project downwardly through an elongated slot 48 which is formed in the top wall of the underlying bracket 22 so that the support arm 46 is hence positionable within the bracket. The mounting arm 46 has an elongated part 49 which protrudes forwardly from one end thereof and is positionable directly below a stop flange 51 which is fixedly associated with the sidewall of the bracket 22, whereby part 49 and flange 51 define a hold-down structure for preventing upward lifting of the work surface member away from the supports 12.

A wave spring 52 is positioned so as to resiliently bear against the free end of the protruding part 49. This wave spring has a vertical plate 53 at its other end which bears against the front wall 19 of the upright, whereby the wave spring hence exerts a rearward (rightward) biasing force against the mounting arm 46 and hence against the work surface member 11. The vertical plate 53 of the wave spring in turn terminates in a top plate 54 which projects inwardly into the upper portion of the bracket 22 and creates a snug or press fit therewith.

Bracket 22 also mounts thereon a locking lever 56, the latter being elongated substantially along the horizontal leg of the bracket and being hingedly supported on the bracket by a hinge 57 which is disposed intermediate the length of the lever. Locking lever 56 has a finger 58 which projects outwardly from the forward free end thereof and is adapted to project through one of the slots 18. The rearward free end of the lever has an actuator plate 59 formed integrally thereon and projecting substantially horizontally therefrom at a location directly below the mounting arm 46. When the bracket 22 is securely seated on the upright 16 and has the work surface member 11 mounted thereon as illustrated in FIG. 2, the mounting arm 46 is disposed directly above the actuator plate 59 so that the locking lever 56 is prevented from swinging in a counterclockwise direction about the hinge 57. At the same time the finger 58 projects through one of the slots 18 and is disposed directly adjacent the upper end of the slot to prevent the finger from swinging or moving upwardly. Hence, this positively prevents the bracket 22 from moving upwardly and becoming disengaged from the upright 16 so long as the work surface member 11 is mounted on the bracket.

To permit limited slidable displacement of the work surface member 11 relative to the brackets 22 so as to increase the width of the clearance space 14, there is provided a releasable latch means 55 which cooperates between the work surface member 11 and the brackets 22. This latch means 55 includes a latching lever 61 which is formed from a horizontally elongated piece of thin vertical plate 62. One of these levers 61 is positioned interiorly of each end rail 36. The lever 61 is, adjacent its forward end, pivotally mounted relative to the end rail 36 by a horizontal hinge 63, the latter being disposed approximately midway between the front and rear edges of the work surface member. The lever 61 projects rearwardly from the hinge 63 to a location disposed closely adjacent the rear edge 64 of the work surface member. The lever 61 has a horizontal support plate 66 fixedly, here integrally, mounted thereon at a location spaced rearwardly from the hinge 63, which support plate in turn has a cantilevered spring plate 67 integral therewith and projecting rearwardly therefrom and disposed for pressing engagement with the underside of the top wall 68 of the end rail 36. This spring plate 67, and its engagement with the rail top wall 68, continuously urges the latching lever 61 downwardly toward the bottom wall 69 of the end rail for maintaining a latched relationship between the work surface member 11 and the underlying bracket 22.

To create the latched relationship, the latching lever 61 has a latching part 71 which projects downwardly therefrom at a location spaced a substantial distance from the hinge 63. This latching part 71 is substantially L-shaped and creates a rearwardly directed notch or slot 72. This latching part 71 projects downwardly through a slot 73 formed in the rail bottom wall 69, and thence through a further slot 74 formed in the top wall of the bracket 22. This slot 74 has a length which slightly exceeds the length of the latching part 71 so that the latter can pass through the slot 74, following which the wave spring 52 urges the work surface member 11 rearwardly (rightwardly) so that the top wall of the bracket, adjacent the rear end of slot 74, projects into the notch 72. This hence vertically locks the work surface member 11 to the bracket 22 and prevents undesired upward lifting of the work surface member in the vicinity of the rear edge thereof, whereby the notch 72 and the rearwardly projecting portion of part 71 located therebeneath hence function as a further hold-down structure for the work surface member.

The latching lever 61 projects rearwardly beyond the latching part 71 and the free end thereof is vertically slidably guided within a vertical guide slot 76 formed in a sleevelike grommet 77, the latter being fixedly positioned within the rearward end of the end rail 36 in the vicinity of the rear edge 64. This grommet 77 opens downwardly through a finger hole 78 formed in the rail bottom wall 69. The latching lever 61 has a substantially horizontal actuator plate 79 fixedly, here integrally, connected thereto adjacent the free end thereof, which actuator plate 79 is disposed within the grommet 77 and hence is accessible through the finger hole 78.

To maintain proper aligned relationship of the work surface member 11 with respect to the brackets 22, there is provided a pin-and-slot arrangement coacting between each end rail 36 and its respective bracket 22. This is provided, in the preferred embodiment, by a small substantially cylindrical pin 81 which is fixed to the work surface member and projects downwardly from the rail bottom wall 69, and an elongated slot 82 which is formed in and extends longitudinally along the top wall of the bracket 22. This slot 82 has a width so as to closely but slidably confine the pin 81. The pin 81 and slot 82 are positioned closely adjacent but slightly forwardly from the latching part 71. The latching engagement and the pin-and-slot guiding structure are both disposed closely adjacent the free end of the horizontal leg of the bracket 22, and are thus disposed in close proximity to the rear or outer free edge of the work surface member. The pin 81 and slot 82 can obviously be reversed so as to be associated with the bracket and work surface member, respectively, if desired.

OPERATION

While the assembly and operation of the work surface assembly is believed apparent from the above description, nevertheless same will be briefly described to ensure a complete understanding thereof.

The support brackets 22 are initially mounted on the uprights 16 and are disposed so that the brackets are in their lowermost seated position, as illustrated by FIG. 2. The work surface member 11 is then positioned over the brackets 22 so that the mounting arms 46 can be moved downwardly through the elongated slots 48 formed in the top walls of the brackets. The work surface member 11 extends at a slight upward angle as it projects rearwardly since the mounting arms 46 project into the brackets, whereas the latching parts 71 still project downwardly beyond the lower surface of the end rails. However, if the weight of the work surface member 11 is permitted to rest on the brackets, then the weight of the work surface member itself will cause the projecting parts 71 and hence the levers 61 to pivot upwardly against the urging of the spring plates 67. The work surface member 11 is then manually pushed forwardly along the brackets toward the panel 13 so that the protruding part 49 slides under the stop 51 and moves into engagement with the wave spring 52. The work surface is manually moved forwardly a greater extent toward the panel 13 until the front edge of the work surface is disposed substantially as illustrated by the dotted line in FIG. 2. When in this latter position, the latching part 71 is aligned with the slot 74 in the bracket, and hence the spring plate 67 swings the latching lever 61 downwardly so that the latching part 71 passes through the slot 74 in the bracket. Thereafter the work surface member is manually released, and the wave spring 52 slidably moves the work surface member 11 rearwardly along the brackets into the solid-line position illustrated in FIG. 2. In this position the top wall of the bracket, at the rearward end of the slot 74, projects into the notch 72 of the latching part 71, thereby preventing further rearward movement of the work surface member and at the same time latching the work surface member against vertical displacement in the vicinity of the rear edge thereof. This latching relationship at the rearward edge, coupled with the disposition of the protruding part 49 under the stop flange 51 at the front edge of the work surface, hence prevents any inadvertent lifting or tilting of the work surface, such as due to a vertical force applied either downwardly or upwardly adjacent the rear edge thereof. When the member 11 is in this operative or use position, the clearance space 14 between the panel and the front edge of the work surface is normally in the order of about one-half inch, which space is sufficient to accommodate passage therethrough of power and communication cords, but is insufficient to permit plugs or connectors to pass therethrough.

Accordingly, to permit a connector or plug to be passed through the space 14, the latching means 60 is released so as to slidably move the work surface member 11 outwardly into a service position so as to increase the width of the space 14, and hence permit a plug or connector to be readily passed through the temporarily enlarged space. To accomplish this function, the work surface member 11 is manually gripped adjacent the opposite rear corners thereof and pushed forwardly (leftwardly) a small distance (such as about ¼ inch) against the urging of spring 52 to move the bracket top wall out of the latching notch 72. A finger is inserted upwardly through the hole 78 associated with each end rail 36, and the actuator plate 79 associated with each end rail is pushed upwardly so as to simultaneously swing the two latching levers 61 upwardly (counterclockwise) against the urging of spring plates 67, thereby moving the latching parts 71 upwardly out of the slots 74. The work surface member 11 is then manually slidably moved rearwardly (rightwardly) by pulling on same, which movement is also at least initially assisted by the urging of the wave spring 52. The work surface member 11 can be moved rearwardly (rightwardly) through a distance of about $1\frac{1}{4}$ inches, thereby substantially increasing the width of the space 14 adjacent the front edge of the work surface. After the work surface member has been initially slidably displaced rearwardly along the brackets, the latching levers 61 can be manually released since the latching parts thereof will engage and slidably move along the upper surface of the rail top wall 28. During this rearward slidable displacement of the work surface member, the guide pins 81 thereon slidably move along the guide slots 82 in the brackets and hence maintain a proper aligned relationship of the work surface member with respect to the brackets. When in this rearward or extended position, the protruding part 49 of the mounting arm 46 is still slidably disposed under the stop flange 51 so as to prevent any inadvertent tipping of the work surface member due to an external downward force being imposed thereon.

After the plugs or connectors have been passed through the enlarged space 14, the work surface member 11 is then manually pushed forwardly (leftwardly) until reaching the forward dotted line position, in which position the latching parts 71 are aligned with the slots 74 whereby the spring plates 67 swing the levers 61 downwardly so that the latching parts pass through the slots 74. The manual forward pushing force is then relieved and the wave spring 52 again pushes the work surface member 11 slightly rearwardly (rightwardly) into the latched position illustrated by solid lines in FIG. 2.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, an upright wall structure defining a pair of horizontally spaced urpights each having a wall with a vertically extending row of elongated slots therein, a bracket structure adapted for releasable securement to each said upright, said bracket structure including forward1y and downwardly projecting hook means positioned for engagement with the slotted wall of the respective upright, and a shelflike structure positioned on and releasably attached to said bracket structures in a normal use position whereby the shelflike structure has a front edge positioned closely adjacent said wall, said shelflike structure projecting substantially horizontally outwardly from said wall in cantilevered relationship thereto, the shelflike structure also having a rear edge which extends substantially parallel to said front edge and remotely located from said wall, the improvement comprising manually releasable latch means coating between shelflike structure and said bracket sturctures for (1) maintaining said shelflike structure in said use position when latched and (2) permitting said shelflike structure to be horizontally slidably moved relative to said bracket sturctures rearwardly away from said wall through a selected extent into a service position when unlatched, said latching means including a manually releasable latching member movably supported on one of said shelflike and bracket structures and being normally biased toward a condition of latching engagement with the other of said shelflike and bracket structures, said latching member having a part thereof which is manually accessible from a location disposed in the vicinity of said rear edge, said latching member comprising a horizontally elongated latching lever pivotally mounted on said shelflike structure adjacent each end edge thereof and disposed for latching engagement with the respectively adjacent bracket structure, said latching lever being hingedly mounted adjacent its forward end on said shelflike structure, said latching lever having adjacent its rearward end a finger-engaging part which is disposed in the vicinity of the rear edge of said shelflike structure so as to be manually releasable, said shelflike structure inlcuding an end rail extending along each and edge thereof between said front and rear edges, said end rail having a substantially hollow channel-like cross section, said latching lever being positioned within and extending along each said end rail, a sleevelike guide grommet fixed within said end rail adjacent the rear edge of said shelflike structure, said sleevelike guide grommet being aligned with an access opening formed in the underside of said end rail, said grommet having a vertical guide slot formed therein, said latching lever adjacent the rear free end thereof having a part thereof vertically slidably guided within said guide slot, said finger-engaging part of said latching lever being positioned within said sleevelike guide grommet, said latching lever having a downwardly projecting latching part protruding downwardly therefrom, slots means formed in and opening downwardly of said bracket structure of receiving therein said latching part when said shelflike structure is in said use position, spring means normally biasing said latching lever in a direction causing said latching part to project into said slot means, and means for slidably guiding the movement of said shelflike structure on said bracket structures as the shelflike sturcture moves between said use and service positions.

2. A combination according to claim 1, wherein the latching part includes means for engagement with said bracket structure when in a latching position for preventing movement of said shelflike structure both upwardly and rearwardly relative to said bracket structure.

3. In combination, an upright wall structure defining a pair of horizontally spaced uprights each having a wall with a vertically extending row of elongated slots therein, a bracket structure adapted for releasable securement to each said upright, said bracket structure including forwardly and downwardly projecting hook means positioned for engagement with the slotted wall of the respective upright, and a shelflike structure positioned on and releasably attached to said bracket structures in a normal use position whereby the shelflike structure has a front edge positioned closely adjacent said wall, said shelflike structure projecting substantially horizontally outwardly from said wall in cantilevered relationship thereto, the shelflike structure also having a rear edge which extends substantially parallel to said front edge and is remotely located from said wall, the improvement comprising manually releasable latch means coacting between said shelflike structure and said bracket structures for (1) maintaining said shelflike structure in said use position when latched and (2) permitting said shelflike structure to be horizontally slidably moved relative to said bracket structures rearwardly away from said wall through a selected extent into a service position when unlatched, said latching means including a manually releasable latching member movably supported on one of said shelflike and bracket structures and being normally biased toward a condition of latching engagement with the other of said shelflike and bracket structures, said latching member having a part thereof which is manually accessible from a location disposed in the vicinity of said rear edge, said latching member comprising a horizontally elongated latching lever pivotally mounted on said shelflike structure adjacent each end edge thereof and disposed for latching engagement with the respectively adjacent bracket structure, said latching lever being hingedly mounted adjacent its forward end on said shelflike structure, said latching lever having adjacent its rearward end a finger-engaging part which is disposed in the vicinity of the rear edge of said shelflike structure so as to be manually releasable, said shelflike structure including an end rail extending along each end edge thereof between said front and rear edges, said end rail having a substantially hollow channel-like cross section, said latching lever being positioned within and extending along each said end rail, said latching lever having a downwardly projecting latching part protruding downwardly therefrom, slot means formed in and opening downwardly of said bracket structure for receiving therein said latching part when said shelflike structure is in said use position, spring means normally biasing said latching lever in a direction causing said latching part to project into said slot means, and pin-and-slot guide means coacting between each said end rail and its respective said bracket structure for guiding the slidable displacement of said shelflike structure relative to said bracket structure between said use and service positions, said pin-and-slot means being disposed in the vicinity of said latching part.

4. A combination according to claim 3, including a mounting arm fixed to and projecting downwardly from said shelflike structure in the vicinity of a front corner thereof, said bracket structure having opening means therein for permitting said mounting arm to project downwardly therein for engagement within said bracket structure, said mounting arm having a part which protrudes forwardly toward said wall, said bracket structure having a stop member which is positionable directly over said protruding part when said shelflike structure is in said use and service positions for preventing upward displacement of the front edge of the shelflike structure relative to said bracket structure, and compression spring means mounted on said bracket structure and compressively coacting between said upright and said mounting arm for urging said shelflike sturcture, when in said use position, rearwardly away from said wall for urging said latching part into latching engagement with said bracket structure.

* * * * *

UNITED STATES PATENT AND TRADEMARK OFFICE

CERTIFICATE OF CORRECTION

PATENT NO. : 4 660 477

DATED : April 28, 1987

INVENTOR(S) : Randall L. KORTERING et al

It is certified that error appears in the above-identified patent and that said Letters Patent is hereby corrected as shown below:

Column 8, line 14; change "and" to ---end---.

Column 8, line 29; change "slots" to ---slot---.

Column 8, line 30; change "of" (second occurrence) to ---for---.

Signed and Sealed this

Tenth Day of November, 1987

*Attest:*

*Attesting Officer*

DONALD J. QUIGG

*Commissioner of Patents and Trademarks*